US009131319B2

(12) United States Patent
Zoellin et al.

(10) Patent No.: US 9,131,319 B2
(45) Date of Patent: Sep. 8, 2015

(54) COMPONENT HAVING A MICROMECHANICAL MICROPHONE STRUCTURE

(71) Applicants: Jochen Zoellin, Muellheim (DE); Ricardo Ehrenpfordt, Korntal-Muenchingen (DE); Juergen Graf, Stuttgart (DE); Christoph Schelling, Stuttgart (DE); Frederik Ante, Stuttgart (DE); Michael Curcic, Stuttgart (DE)

(72) Inventors: Jochen Zoellin, Muellheim (DE); Ricardo Ehrenpfordt, Korntal-Muenchingen (DE); Juergen Graf, Stuttgart (DE); Christoph Schelling, Stuttgart (DE); Frederik Ante, Stuttgart (DE); Michael Curcic, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 5 days.

(21) Appl. No.: 14/046,587

(22) Filed: Oct. 4, 2013

(65) Prior Publication Data

US 2014/0105428 A1 Apr. 17, 2014

(30) Foreign Application Priority Data

Oct. 11, 2012 (DE) ..... 10 2012 218 501

(51) Int. Cl.

| | |
|---|---|
| ***H04R 25/00*** | (2006.01) |
| ***H04R 23/00*** | (2006.01) |
| ***H04R 19/04*** | (2006.01) |
| ***H04R 7/14*** | (2006.01) |
| *H04R 19/00* | (2006.01) |

(52) U.S. Cl.

CPC ..... *H04R 23/00* (2013.01); *H04R 7/14* (2013.01); *H04R 19/04* (2013.01); *H04R 19/005* (2013.01); *H04R 2410/03* (2013.01)

(58) Field of Classification Search

CPC .... H04R 19/005; H04R 19/04; H04R 19/016; H04R 2201/003; H04R 2300/00; H04R 31/00; B81B 3/0021; B81B 2201/0257; B81B 3/0072

USPC ..... 381/355, 369, 174, 175, 191; 257/416; 438/48–53; 367/170, 181

See application file for complete search history.

(56) References Cited

U.S. PATENT DOCUMENTS

| | | | | |
|---|---|---|---|---|
| 8,637,945 | B2 * | 1/2014 | Reichenbach et al. | 257/416 |
| 2006/0093170 | A1 * | 5/2006 | Zhe et al. | 381/191 |
| 2013/0243234 | A1 * | 9/2013 | Zoellin et al. | 381/369 |
| 2014/0015070 | A1 * | 1/2014 | Zoellin et al. | 257/416 |

(Continued)

FOREIGN PATENT DOCUMENTS

DE 102012215251 A1 * 3/2013

*Primary Examiner* — Davetta W Goins
*Assistant Examiner* — Phylesha Dabney
(74) *Attorney, Agent, or Firm* — Kenyon & Kenyon LLP

(57) ABSTRACT

A capacitive MEMS microphone structure is provided, which micromechanical microphone structure of component is realized in a layer construction and includes: a diaphragm structure sensitive to sound pressure, which is deflectable in a direction perpendicular to the layer planes of the layer construction; an acoustically penetrable counter-element which has through holes and is formed above or below the diaphragm structure in the layer construction; and a capacitor system for detecting the excursions of the diaphragm structure. The diaphragm structure includes a structural element in the middle area of the diaphragm structure, which structural element projects perpendicularly from the diaphragm plane and which, depending on the degree of excursion of the diaphragm structure, variably extends into a correspondingly formed and positioned through hole in the counter-element.

9 Claims, 4 Drawing Sheets

(56) References Cited

U.S. PATENT DOCUMENTS

2014/0105428 A1* 4/2014 Zoellin et al. ..... 381/174
2014/0109680 A1* 4/2014 Tsai ..... 73/702
2014/0233767 A1* 8/2014 Chen et al. ..... 381/174
2015/0110309 A1* 4/2015 Park et al. ..... 381/190

* cited by examiner

COMPONENT HAVING A MICROMECHANICAL MICROPHONE STRUCTURE

BACKGROUND OF THE INVENTION

1. Field of the Invention

The present invention relates to a component having a micromechanical microphone structure which is realized in a layer construction. The microphone structure includes at least one diaphragm structure which is sensitive to sound pressure and is deflectable essentially in a direction perpendicular to the layer planes of the layer construction; an acoustically penetrable counter-element having through holes, which is formed above or below the diaphragm structure in the layer construction; and a capacitor system for detecting the excursions of the diaphragm structure.

2. Description of the Related Art

MEMS (Micro-Electro-Mechanical-System) microphones of the type discussed here have been known for years and are employed within the framework of widely varying practical applications.

MEMS microphones are common which have a flat diaphragm structure that is parallel to the chip or substrate plane and is excited to vertical (out-of-plane) vibrations by exposure to sound on the front or back side. The signal acquisition is generally carried out capacitively. To that end, disposed on the diaphragm structure is an electrode which, together with a further electrode on a stationary counter-element, forms a capacitor system, so that excursions of the diaphragm structure produce a change in capacitance of this microphone capacitor.

The larger the diaphragm surface, the more sensitive the diaphragm structure is with respect to changes in pressure or acoustic excitation, and the larger it is possible to dimension the surface area of the electrodes of the capacitor system, in order to attain the greatest possible change in capacitance in response to a given diaphragm excursion. For this reason, high microphone sensitivity and the miniaturization of the component are only conditionally compatible with each other. In addition, the production, adjustment and conditioning of large, self-supporting, thin layers as needed for microphone diaphragms are associated with considerable expenditure for development and processing.

BRIEF SUMMARY OF THE INVENTION

The present invention provides a concept for the realization of capacitive MEMS microphones having high measuring sensitivity, accompanied by comparatively small chip area.

The component concept according to the present invention provides that the diaphragm structure includes at least one structural element which projects essentially perpendicularly from the diaphragm plane and which, depending on the degree of excursion of the diaphragm structure, extends to a greater or lesser extent into a correspondingly formed and positioned through hole in the counter-element. This structural element projecting from the diaphragm plane is located in the middle area of the diaphragm structure.

The capacitive effect of the out-of-plane movement of the diaphragm structure is amplified here by a "meshing" of the diaphragm structure and counter-element. To that end, in contrast to the related art, the diaphragm structure is not essentially flat, but rather three-dimensional.

Usually, the edge area of the diaphragm structure is tied into the layer construction of the component, so that upon being acted upon by sound, the middle area of the diaphragm structure—and therefore also the structural element situated in this area and projecting from the diaphragm plane—undergoes the greatest excursion. In addition, in this case, the structural element is deflected in a direction essentially perpendicular to the diaphragm plane, so that it cannot catch an edge in the through hole in the counter-element.

In principle, there are many different possibilities for realizing the component concept of the present invention, especially as far as the three-dimensional form of the diaphragm structure is concerned.

The microphone sensitivity of a component according to the present invention essentially is a function of the degree of meshing between the diaphragm structure and the counter-element. The greater the degree of meshing, the greater the microphone sensitivity, as well. Therefore, the diaphragm structure of one preferred specific embodiment of the component according to the present invention includes a comb structure which projects essentially perpendicularly from the diaphragm plane and which, depending on the degree of excursion of the diaphragm structure, extends to a greater or lesser extent into correspondingly formed and positioned through holes in the counter-element.

In one especially advantageous specific embodiment of the present invention, the microphone structure includes two acoustically penetrable counter-elements that are formed above and below the diaphragm structure, so that the diaphragm structure is disposed and deflectable in a gap between the two counter-elements. The diaphragm structure is provided on both sides with structural elements oriented perpendicularly to the layer planes, so that they extend to a greater or lesser extent into correspondingly formed and positioned through holes in the counter-elements, depending on the degree of excursion of the diaphragm structure. This microphone structure, toothed on two sides, likewise contributes to the increase in microphone sensitivity, and in addition, permits a differential signal acquisition.

Moreover, the microphone sensitivity may be increased by the type of connection of the diaphragm structure to the layer construction of the component. The aim is always for an especially great and most plane-parallel excursion possible of the middle area of the diaphragm structure, where the structural elements are formed projecting essentially perpendicularly from the diaphragm plane. In this manner, not only is the highest possible change in capacitance attained, but also the structural elements of the diaphragm structure are prevented from sticking mechanically in the through holes of the counter-element. In this connection, it proves to be advantageous if the diaphragm structure is tied into the layer construction of the component via a spring suspension. Upon exposure to sound, first and foremost, the spring suspension of the diaphragm structure is deformed, while the middle area is deflected in essentially plane-parallel fashion. Alternatively or additionally, the middle area of the diaphragm structure may be stiffened in order to prevent a deformation of the middle area. In this manner, the orientation of the structural elements in alignment with the through holes in the counter-element is also stabilized.

To reduce the weight of the diaphragm structure, it may be perforated in the middle area, for example, which likewise contributes to the microphone performance of the component according to the present invention.

Advantageously, the component of the present invention is equipped with an overload protection for the diaphragm structure, which, for instance, may be realized in the form of mechanical stops for the diaphragm structure. They may be formed on the diaphragm structure itself, on the counter-element, or perhaps in the edge area of a sound opening.

As already mentioned, the signal acquisition within the scope of the component concept according to the present invention is accomplished capacitively with the aid of a capacitor system, to which a defined capacitor voltage is applied.

In a first realization variant, this capacitor system includes at least one fixed electrode on the counter-element and at least one electrode on the diaphragm structure, so that in response to an excursion of the diaphragm structure, the electrode spacing of the capacitor system, and therefore its capacitance, changes. In this case, the structural elements of the diaphragm structure projecting from the diaphragm plane contribute to an increase of the electrode area, and therefore of the measuring signal. In this variant of the signal acquisition, because of the voltage applied to the capacitor system, at high sound pressures, a pull-in of the diaphragm structure to the counter-element may take place, which subsequently impairs the signal acquisition.

In a second realization variant, such an impairment of the signal acquisition is ruled out. Here, the diaphragm structure acts not as an electrode, but rather as a dielectric of the capacitor system. To that end, the diaphragm structure is made at least partially of a dielectric material or is coated with a dielectric material, and specifically, particularly the parts of the diaphragm structure which extend into the through holes in the counter-element. Here, the electrodes of the capacitor system are realized on the counter-element in such a way that, in response to an excursion of the diaphragm structure, the dialectic properties change in the electrode gap of the capacitor system. The excursion of the diaphragm structure is independent here of the capacitor voltage, since in this embodiment variant, the voltage is applied between two fixed electrodes on the counter-element. An unwanted pull-in of the diaphragm to the counter-element is therefore ruled out, even at high sound pressures.

DETAILED DESCRIPTION OF THE INVENTION

Figure 1:
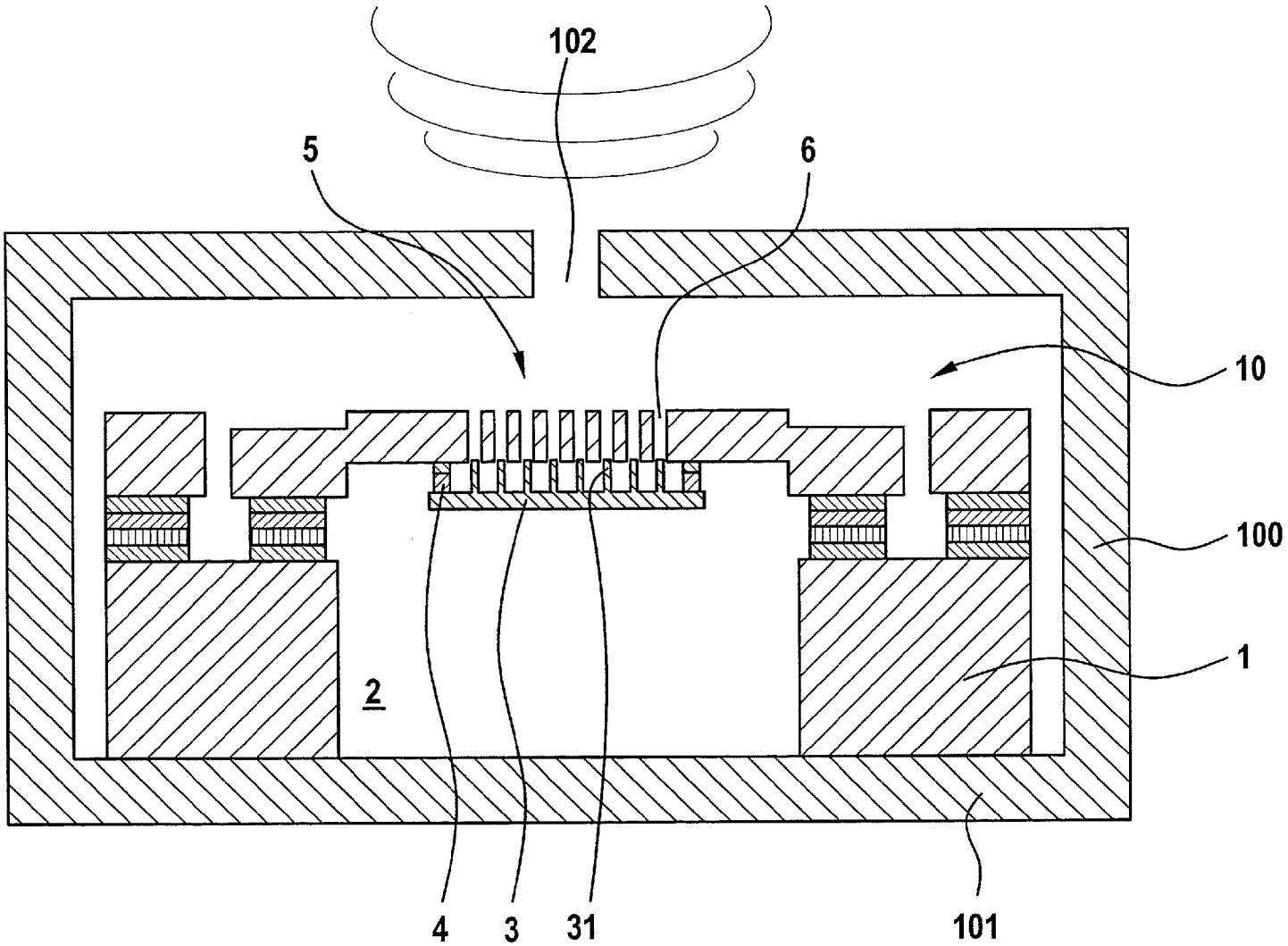
FIG. 1 shows a schematic sectional view of a first microphone component 10 according to the present invention.

Microphone component 10 shown in FIG. 1 is a MEMS component which is realized in a layer construction, starting from a substrate 1. The microphone structure of component 10 overspans a cavity 2 in the back side of the substrate. It includes a diaphragm structure 3 sensitive to sound pressure, which is deflectable in a direction essentially perpendicular to the layer planes of the layer construction, thus, out-of-plane. The microphone structure also includes an acoustically penetrable counter-element 5 having through holes 6. In the exemplary embodiment shown here, counter-element 5 is disposed above diaphragm structure 3 in the layer construction. Diaphragm structure 3 is connected to counter-element 5, and specifically, via spring elements 4 which are formed in the edge area of diaphragm structure 3. In an exemplary embodiment not shown, diaphragm structure 3 may also be disposed above counter-element 5.

According to the invention, diaphragm structure 3 includes structural elements 31 which project essentially perpendicularly from the diaphragm plane and—depending on the degree of excursion of diaphragm structure 3—extend to a greater or lesser extent into correspondingly formed and positioned through holes 6 in counter-element 5. Accordingly, structural elements 31 point in the direction of counter-element 5 and are formed in alignment with through holes 6 in counter-element 5. In the case of component 10 shown here, structural elements 31 of diaphragm structure 3 form a comb structure engaging in the structure of counter-element 5.

In order to realize the microphone function, component 10 was provided with a housing 100. Component 10 is mounted on housing bottom 101 on the substrate side, so that cavity 2 is sealed in pressure-tight fashion on the back side and acts as back volume. A sound opening 102 is located in the top side of housing 100, so that the sound pressure acts on diaphragm structure 3 via through holes 6 in counter-element 5 and sets it into vibration. In this context, the middle area of diaphragm structure 5 is deflected essentially in plane-parallel fashion, while spring elements 4 are deformed, since the middle area having comb structure 31 is markedly stiffer than spring elements 4.

Signals are acquired capacitively with the aid of a capacitor system which, in the case of component 10, includes a movable electrode on diaphragm structure 3 and a fixed electrode on counter-element 5. For example, the electrodes of the capacitor system may be implemented in a conductive layer of the counter-element and of the diaphragm structure, respectively, or perhaps in the form of a suitable doping, and are not shown in detail here. In any case, because of comb structure 31 of diaphragm structure 3, the electrode area of this capacitor system is markedly greater than the chip area occupied by diaphragm structure 3. Due to the excursion of diaphragm structure 3, the electrode spacing of the capacitor system, and therefore also its capacitance, changes.

Figure 2:
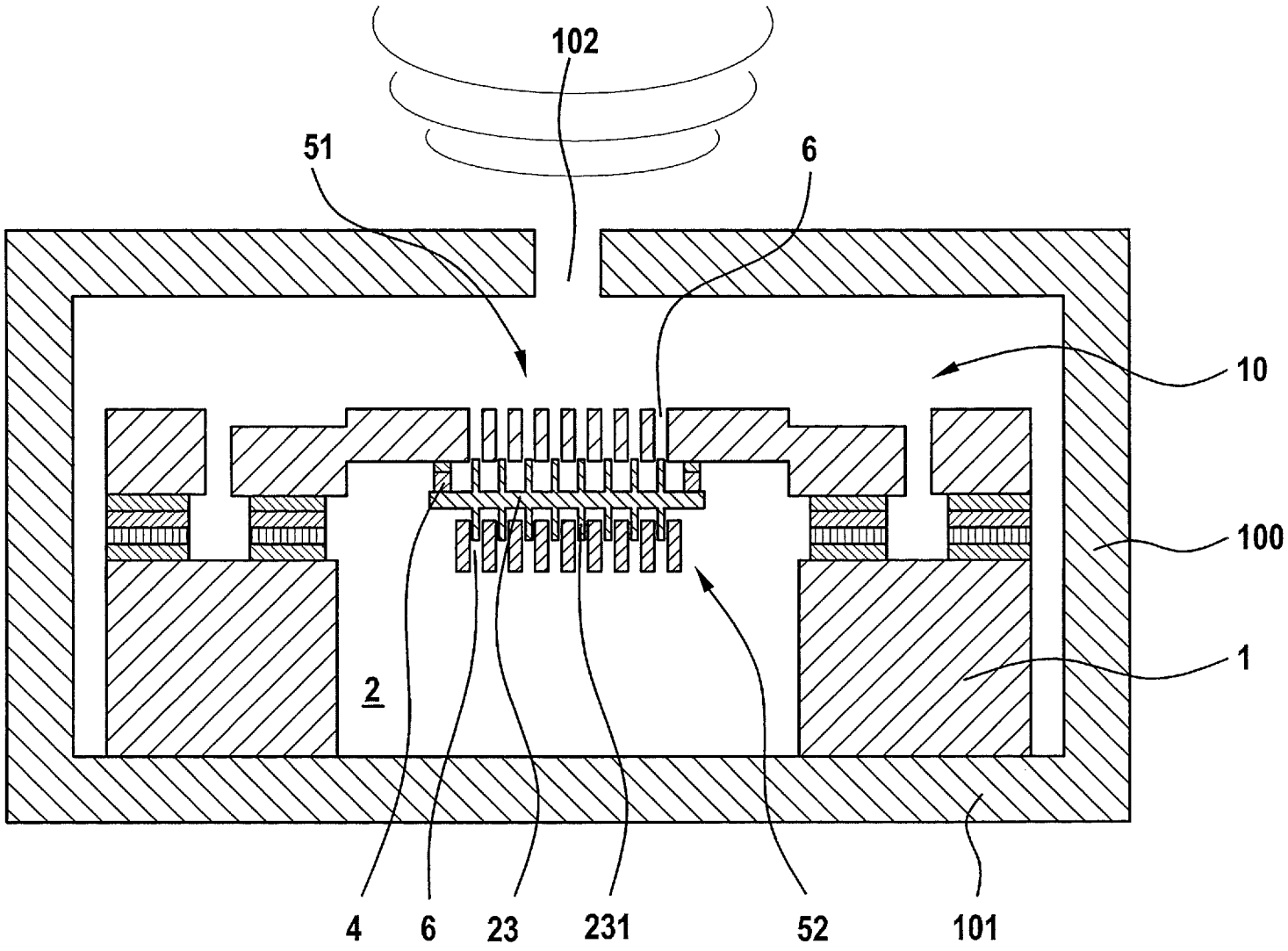
FIG. 2 shows a schematic sectional view of a second microphone component 20 according to the present invention.

In contrast to component 10 shown in FIG. 1, the microphone structure of microphone component 20 shown in FIG. 2 includes two stationary counter-elements 51 and 52, which are realized above and below diaphragm structure 23 in the layer construction, so that diaphragm structure 23 is sandwiched in a gap between the two counter-elements 51, 52. Through holes 6 are formed in both counter-elements 51 and 52, so that both counter-elements 51, 52 are acoustically penetrable. Diaphragm structure 23 is connected to upper counter-element 51 via spring elements 4 and is deflectable essentially in a direction perpendicular to the layer planes. The middle area of diaphragm structure 23 has a double comb structure which is formed by structural elements 231 projecting on two sides from the diaphragm plane. They extend into correspondingly dimensioned through holes 6 in upper and lower counter-elements 51, 52 and are positioned in alignment with these through holes 6.

To realize the microphone function, component 20 is also mounted on bottom 101 of a housing 100 on the substrate side, so that cavity 2 below the microphone structure is sealed in pressure-tight fashion on the back side and acts as back volume. Sound is admitted via a sound opening 102 in the top side of housing 100, so that the sound pressure acts upon diaphragm structure 23 via through holes 6 in upper counter-element 51 and sets it into vibration. In this context, double comb structure 231 in the middle area of diaphragm structure 3 is deflected essentially in plane-parallel fashion, while spring elements 4 are deformed. Upon each excursion of diaphragm structure 23, the engagement of double comb structure 231 in through holes 6 of the one counter-element 51 or 52 increases to the extent that it decreases in the case of second counter-element 52 or 51 disposed on the opposite side. This circumstance permits a differential signal acquisition and evaluation and/or a signal feedback, so that the diaphragm structure remains in the position of rest. In this case, the non-linearity of the microphone signal is especially low.

In addition, the capacitor system of microphone component 20 includes at least one fixed electrode on each of the two counter-elements 51 and 52 and at least one deflectable electrode on diaphragm structure 23. As in the case of FIG. 1, the electrodes of the capacitor system are not shown in detail in FIG. 2, either.

Figure 3A:
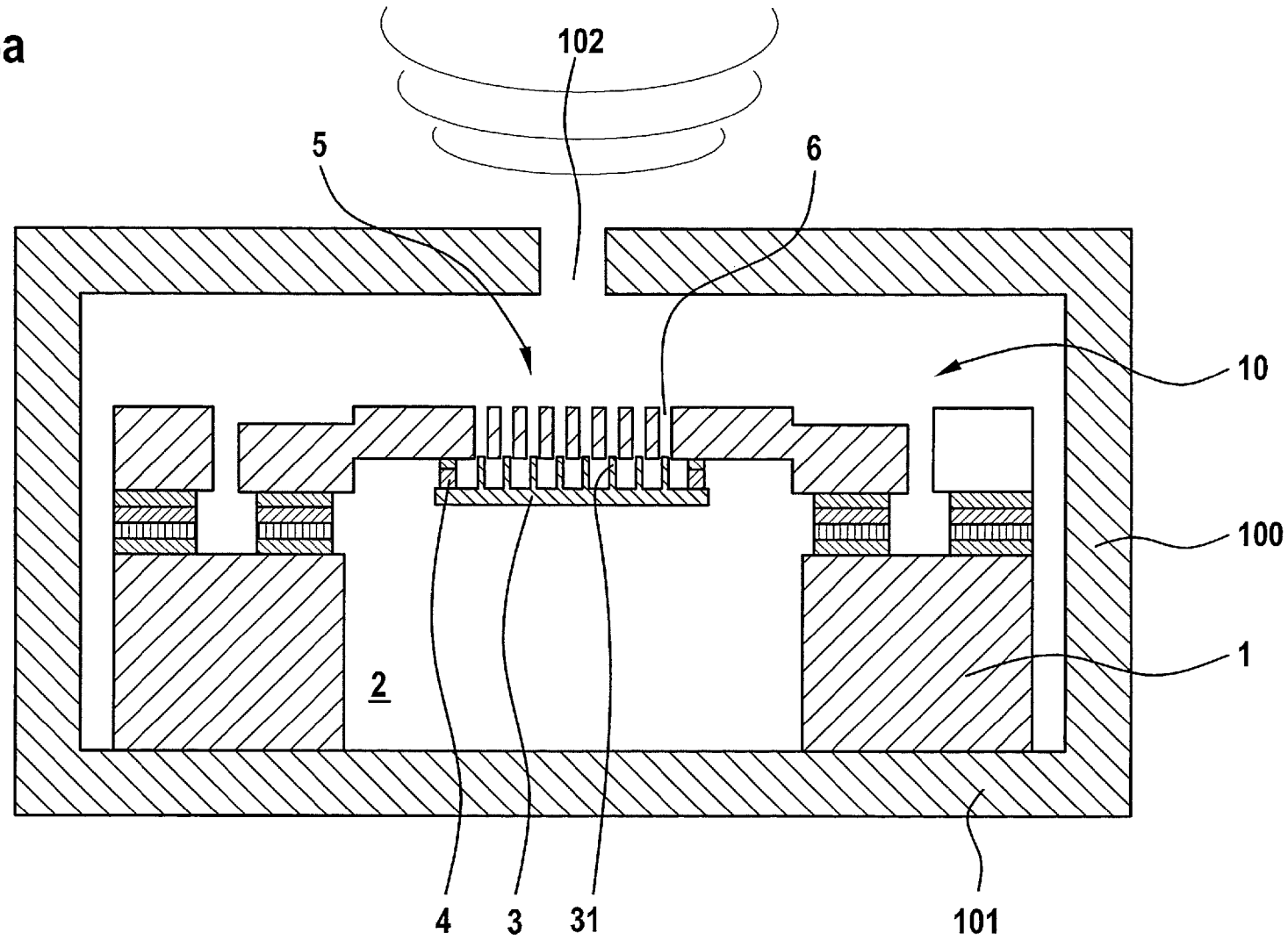
FIG. 3*a* shows a schematic sectional view of a third microphone component 30 according to the present invention.
Figure 3B:
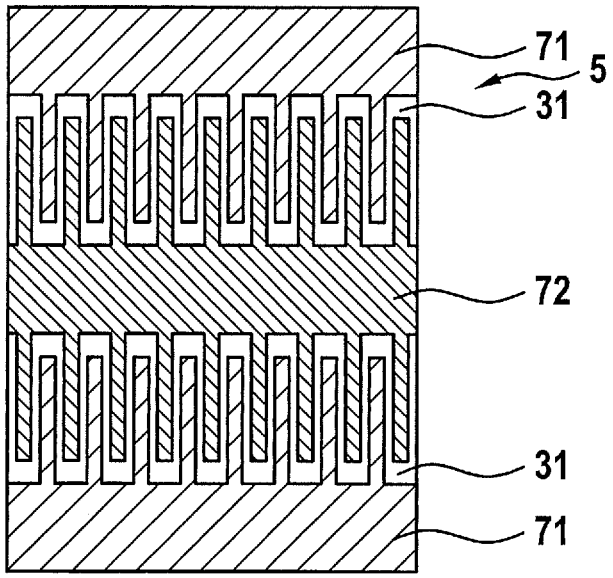
FIG. 3*b* shows a top view of the capacitor system of this microphone component 30.

The component structure of microphone component 30 shown in FIGS. 3*a*, 3*b* corresponds—at least in cross-section—to that of microphone component 10 shown in FIG. 1. Therefore, reference is made to the description of FIG. 1 on this matter. However, the two components 10 and 30 differ in the realization of the capacitor system for the signal acquisition. Thus, the capacitor system of component 30 includes two fixed electrodes 71, 72, both being patterned out of counter-element 5 and thus being disposed in one plane of the layer construction. In the exemplary embodiment shown here, the two electrodes 71 and 72 are comb-shaped, so that the finger structures of the two electrodes 71, 72 mesh, which is illustrated especially by FIG. 3*b*. The gap between the two electrodes 71 and 72 extends over the entire thickness of counter-element 5, and accordingly, forms a through hole 6 for the application of sound to diaphragm structure 3 located below it. Structural elements 31 on diaphragm structure 3, which project from the diaphragm plane, are bar-like here and formed so as to correspond to this electrode gap 6. They are made of a dielectric material. By excursion of diaphragm structure 3, the dielectric properties in the gap of the capacitor system, and therefore also its capacitance, change accordingly, which is ascertainable as measuring signal and may be evaluated.

What is claimed is:

1. A component having a micromechanical microphone structure which is realized in a layer construction, comprising:

a diaphragm structure which is sensitive to sound pressure and configured to be deflectable in a direction essentially perpendicular to layer planes of the layer construction;

at least one acoustically penetrable counter-element having through holes, wherein the counter-element is formed one of above or below the diaphragm structure in the layer construction; and a capacitor system for detecting excursions of the diaphragm structure;

wherein the diaphragm structure includes at least one structural element disposed in the middle area of the diaphragm structure and which projects essentially perpendicularly from the diaphragm plane and which, depending on the degree of excursion of the diaphragm structure, extends to one of a greater or lesser extent into at least one correspondingly formed and positioned through hole in the counter-element.

2. The component as recited in claim 1, wherein the diaphragm structure includes a comb structure which, depending on the degree of excursion of the diaphragm structure, extends to one of a greater or lesser extent into correspondingly formed and positioned through holes in the counter-element.

3. The component as recited in claim 2, wherein:

the microphone structure includes two acoustically penetrable counter-elements having through holes;

the diaphragm structure is sandwiched between the two counter-elements; and the diaphragm structure is provided on both sides with structural elements which (i) are oriented perpendicularly to the layer planes and which (ii) extend to one of a greater or lesser extent into correspondingly formed and positioned through holes in the counter-elements, depending on the degree of excursion of the diaphragm structure.

4. The component as recited in claim 2, wherein the capacitor system includes at least one fixed electrode and at least one deflectable electrode, and wherein the at least one counter-element acts as a carrier for the at least one fixed electrode and the diaphragm structure acts as a carrier for the at least one deflectable electrode, such that the electrode spacing of the capacitor system changes in response to an excursion of the diaphragm structure.

5. The component as recited in claim 2, wherein:

at least a portion of the at least one structural element projecting from the diaphragm plane is one of (i) made of a dialectic material or (ii) coated with a dielectric material; and in response to plunging of the structural element projecting from the diaphragm plane into the plane of the counter-element due to an excursion of the diaphragm structure, the dialectic properties in an electrode gap between two mutually galvanically-separated electrodes of a capacitor system on the at least one counter-element changes.

6. The component as recited in claim 2, wherein the diaphragm structure is integrated into the layer construction via a spring suspension.

7. The component as recited in claim 2, wherein the middle area of the diaphragm structure is stiffened.

8. The component as recited in claim 2, wherein the diaphragm structure is perforated at least in the middle area.

9. The component as recited in claim 2, wherein an overload protection is provided for the diaphragm structure, the overload protection being configured in the form of stop elements on the diaphragm structure.

* * * * *